US006650035B2

(12) United States Patent
Matsudate

(10) Patent No.: US 6,650,035 B2
(45) Date of Patent: Nov. 18, 2003

(54) COLOR CATHODE RAY TUBE HAVING A SHADOW MASK FORMED OF A PLATE ELEMENT MADE OF AN IRON MATERIAL HAVING AN ALLOY ELEMENT

(75) Inventor: Noriharu Matsudate, Kujukuri (JP)

(73) Assignee: Hitachi, Ltd., Tokyo (JP)

( * ) Notice: Subject to any disclaimer, the term of this patent is extended or adjusted under 35 U.S.C. 154(b) by 6 days.

(21) Appl. No.: 10/037,071

(22) Filed: Nov. 9, 2001

(65) Prior Publication Data

US 2002/0079815 A1 Jun. 27, 2002

(30) Foreign Application Priority Data

Nov. 22, 2000 (JP) ..... 2000-355771

(51) Int. Cl.[7] ..... H01J 29/80
(52) U.S. Cl. ..... 313/402; 313/405; 313/407
(58) Field of Search ..... 313/402, 403, 313/404, 405, 406, 407, 408

(56) References Cited

U.S. PATENT DOCUMENTS 4,596,943 A * 6/1986 Akiyoshi et al. ..... 313/402
4,612,061 A * 9/1986 Suzuki et al. ..... 148/284
4,864,188 A * 9/1989 Sugai et al. ..... 313/402
5,348,827 A * 9/1994 Hatano ..... 430/11
5,686,784 A * 11/1997 Thoms et al. ..... 313/402
5,811,918 A * 9/1998 Van Den Berg et al. .... 313/402
5,850,121 A * 12/1998 Matsudate ..... 313/402
6,133,681 A * 10/2000 Nakamura et al. ..... 313/402
6,489,711 B2 * 12/2002 Makita et al. ..... 313/402

FOREIGN PATENT DOCUMENTS

JP 11050144 A * 2/1999 ..... C21D/8/02

* cited by examiner

*Primary Examiner*—Vip Patel
*Assistant Examiner*—Kevin Quarterman
(74) *Attorney, Agent, or Firm*—Milbank, Tweed, Hadley & McCloy LLP

(57) ABSTRACT

To realize a press mask having a large radius of curvature by making the press mask correct a doming by itself, as material which constitutes a shadow mask, a single plate body which is formed of a composite gradient alloy plate having a concentration gradient of an alloy element which is continuously and gradually decreased from a phosphor-screen-side surface to an electron-gun-side surface is used.

18 Claims, 8 Drawing Sheets

Ry=1300
Rx=1600

Tr>>Tc

COLOR CATHODE RAY TUBE HAVING A SHADOW MASK FORMED OF A PLATE ELEMENT MADE OF AN IRON MATERIAL HAVING AN ALLOY ELEMENT

BACKGROUND OF THE INVENTION

1. Field of the Invention

The present invention relates to a color cathode ray tube of a shadow mask type, and more particularly, to a highly reliable color cathode ray tube which can enhance the material strength of a shadow mask, can improve the etching characteristic and formability, and can decrease the thermal deformation.

2. Description of the Related Art

With respect to color cathode ray tubes which are used as monitor devices for information equipment or display means of color picture receivers of recent year, a flat face technique which makes a panel (face panel) constituting an image display surface flat has been rapidly spreading. Particularly, when a shadow mask of a press forming type which has an apertured surface thereof curved in the horizontal direction and in the vertical direction is adopted, the panel of the color cathode ray tube (flat-face tube) having the flat face has an approximately planar outer surface and an inner surface which has a curvature considerably larger than that of the outer surface.

SUMMARY OF THE INVENTION

As one of the technical tasks at the time of designing such a flat face tube, the shadow mask strength is named. Although the shadow mask is formed with a curvature which approximates the curvature of the inner surface of the panel, the flat face tube has the small curvature of inner surface of the panel compared with a round face tube which has both of inner and outer surfaces thereof curved and hence, there is no other way but to make the curvature of the shadow mask of the flat face tube also small. Accordingly, it is difficult to maintain the strength against the thermal deformation generated by a so-called doming phenomenon of the apertured surface of the shadow mask which is caused by the elevation of the temperature of the shadow mask upon impingement of electron beams in operation. Further, it is also difficult to maintain the physical strength against the falling of the shadow mask, the shock or the like.

As the material which ensures the strength of the shadow mask of this type, cobalt-doped Invar material which is produced by doping cobalt in conventional Invar material has been used.

Although aluminum killed steel material was used as the shadow mask material, recently Invar material has been used along with efforts to enhance the definition of the images and to make the screen further flat. The cobalt-added Invar material which is used for enhancing the strength of the shadow mask ensures the approximately 20% increase of the strength compared with the usual Invar material and can suppress the above-mentioned deformation of the shadow mask. However, the shadow mask produced by doping cobalt in the Invar material has several defects including (1) the cost is pushed up since the cobalt is expensive, (2) the etching efficiency is decreased since the erosion resistance of cobalt is favorable, (3) the workability is decreased and (4) the magnetic characteristics is decreased.

Accordingly, it is an object of the present invention to provide a flat-face type color cathode ray tube having a shadow mask which can decrease drawbacks which such a conventional shadow mask suffers from.

A typical gist of the present invention to achieve the above-mentioned object lies in that a shadow mask material which is served for a color cathode ray tube is made of an iron material which is formed of a plate body doped with an alloy element and has a concentration gradient of the alloy element which is gradually decreased from one surface of the plate body to the other surface of the plate body. Typical constitutions of the present invention are as follows.

(1) In a color cathode ray tube having an evacuated envelope which includes a panel which coats phosphor of a plurality of colors on an inner surface thereof, a neck which houses an electron gun and a funnel which connects the panel and the neck, and a shadow mask which is installed close to the phosphor coated on the inner surface of the panel and has a large number of color selection apertures, wherein material which constitutes the shadow mask is formed of a single plate body made of an iron material containing an alloy element and the single plate body is a composite gradient alloy plate having a concentration gradient of the alloy element which is continuously decreased from a phosphor-side surface to an electron-gun-side surface.

(2) When the signal plate body which constitutes the composite gradient alloy plate contains nickel as the alloy element, the content of nickel in the vicinity of the phosphor-side surface of the single plate body is set to not more than 45 wt % and the content of nickel in the vicinity of the electron-gun-side surface of the single plate body is set to not less than 0 wt %.

(3) In the above-mentioned case (2) in which the signal plate body which constitutes the composite gradient alloy plate contains nickel as the alloy element, the content of nickel in the vicinity of the phosphor-side surface of the single plate body is set to not more than 36 wt % and the content of nickel in the vicinity of the electron-gun-side surface of the single plate body is set to not less than 16 wt %.

(4) The color selection apertures formed in the shadow mask are formed in a dot array and the whole shadow mask is formed of a type which maintains a shape thereof by itself.

(5) The color selection apertures formed in the shadow mask are formed like a plurality of continuous lines extending in one direction and tension is applied to a member which forms the line-like apertures in the extension direction of the apertures.

(6) The color selection apertures formed in the shadow mask are formed of a plurality of slots having long axes thereof extended in one direction and the whole shadow mask is formed of a type which maintains a shape thereof by itself or tension is applied to the shadow mask in the long-axis direction of the slot-like apertures or in the long-axis direction as well as in the short-axis direction.

The present invention is not limited to the above-mentioned constitutions and structures which will be explained in embodiments described later and various modification may be conceivable without departing from the technical concept of the present invention.

PREFERRED EMBODIMENTS OF THE PRESENT INVENTION

Preferred embodiments of a color cathode ray tube according to a present invention are explained in conjunction with attached drawings hereinafter.

Figure 1:
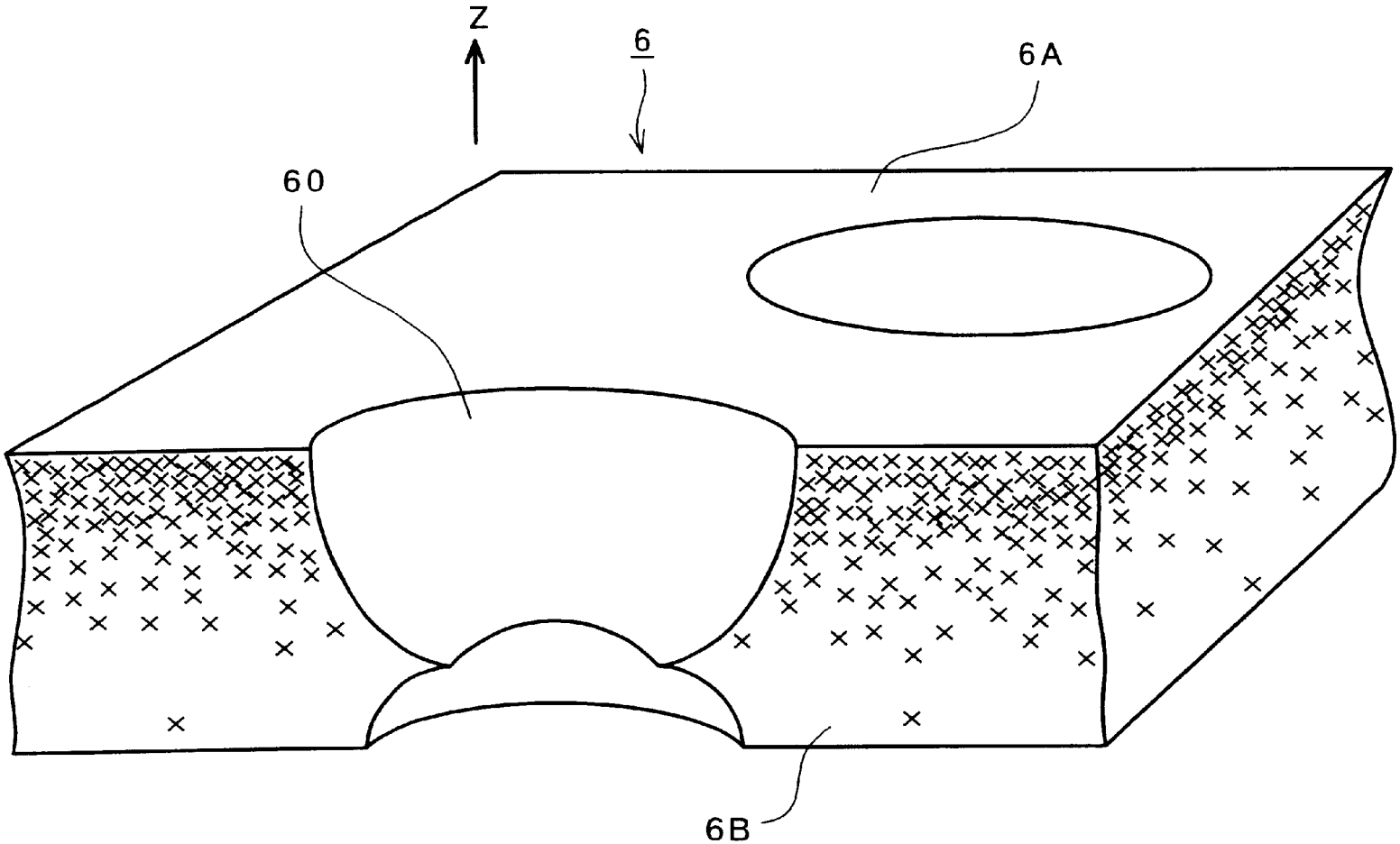
FIG. 1 is a cross-sectional schematic view of an essential part of a shadow mask for explaining the first embodiment of a color cathode ray tube of the present invention.
Figure 2:
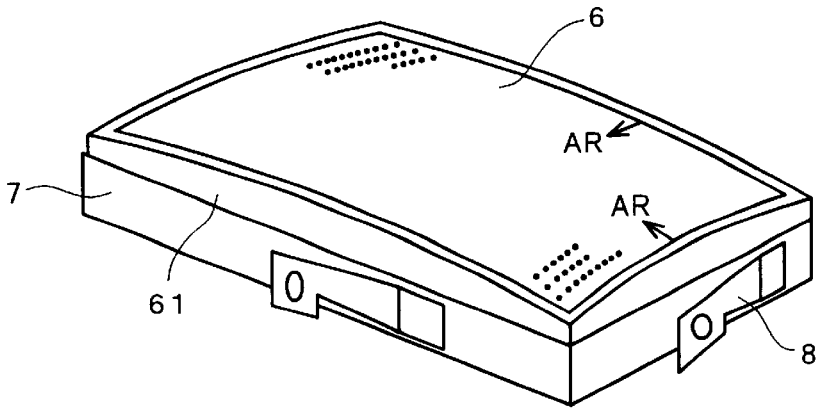
FIG. 2 is a perspective view of a shadow mask structural body installed in the first embodiment of a color cathode ray tube of the present invention.

FIG. 1 is a cross-sectional schematic view of an essential part of a shadow mask for explaining the first embodiment of a color cathode ray tube of the present invention and FIG. 2 is a perspective view of a shadow mask structural body installed in the first embodiment of a color cathode ray tube of the present invention.

With respect to a shadow mask 6 shown in FIG. 2, an apertured region AR which constitutes a main portion of the shadow mask 6 is formed into a curved surface which corresponds to the curvature of an inner surface of a face panel which will be explained later and peripheral portions 61 which are bent in the approximately tube axis direction are fixedly secured to a mask frame 7 thus constituting a shadow mask structural body. The mask frame 7 is provided with suspension springs 8 which are engaged with stud pins which are mounted on an inner wall of a skirt portion of the face panel in a protruding manner. (This constitution will be explained later.)

The shadow mask material which constitutes the shadow mask 6 of this embodiment is basically made of an iron material which includes nickel as an alloy element. The shadow mask 6 is constituted of a single plate body made of a composite gradient alloy plate, wherein the composite gradient alloy plate is comprised of a first composition portion 6A which forms one of surfaces in the Z axis direction (tube axis: arrow Z) of FIG. 1, that is, a phosphor screen side where the content of nickel is maximum and a second composition portion 6B which forms the other surface in the Z axis direction opposite to the above-mentioned one surface, that is, the electron gun side where the content of nickel is minimum.

The content of nickel is continuously decreased from the first composition portion to the second composition portion. The single plate body in which the alloy element is continuously decreased from one surface side of the single plate body to the other surface side of the single plate body is referred to as "composite gradient alloy plate" in this specification.

In FIG. 1, the nickel element used as the alloy element of the composite gradient alloy plate is schematically indicated by "x" and the difference of the content of nickel between the phosphor screen side and the electron gun side along a cross section of the composite gradient alloy plate which constitutes the shadow mask 6 is indicated by the density of x.

In other words, the composite gradient alloy plate may be referred to as a single plate body which has a continuous alloy region in an intermediate region between a first metal plate having the first composition portion 6A and a second metal plate having the second composition portion 6B. However, this composite gradient alloy plate is different from a conventional so-called clad plate material which is formed by laminating two sheets of different kinds of metal plates. In the clad plate material, the gradient of the content of the alloy element shown in FIG. 1 is not observed.

The first composition portion 6A may be formed of an iron-nickel alloy plate and the second composition portion 6B may be formed of an iron plate, wherein the nickel content of the second composition portion 6B may be set to 0. Alternatively, the first composition portion 6A may be formed of metal having a large nickel content and the second composition portion 6B may be formed of metal having a small nickel content. To be more specific, the first composition portion 6A may be formed of Invar material (a nickel-iron alloy containing approximately 36 wt % of nickel) and the second composition portion 6B may be formed of stainless steel containing approximately 16 wt % of nickel or the first composition portion 6A may be formed of stainless steel containing approximately 17 wt % of nickel and the second composition portion 6B may be formed of stainless steel containing approximately 16 wt % of nickel.

Further, the first composition portion 6A may be formed of permalloy (a nickel-iron alloy containing approximately 43 wt % of nickel). Here, to take the magnetic characteristics or cost of the material into consideration, it is preferable to restrict the nickel content to not more than 45 wt %.

The shadow mask 6 of this embodiment is produced by forming electron beam apertures 60 which constitute color selection apertures in such a composite gradient alloy plate by etching. These electron beam apertures 60 have a dot shape which defines a large diameter at the phosphor screen side and a small diameter at the electron gun side. The shadow mask 6 in which the electron beam apertures 60 are formed is molded into a given shadow mask shape by press forming and then is welded to the mask frame 7 shown in FIG. 2 and a shadow mask structural body is formed by mounting the suspension springs 8 to the mask frame 7.

In the embodiment shown in FIG. 1, the shape of the electron beam apertures 60 is formed into a dot shape having an approximately circular shape. However, the present invention is not limited to such a configuration. That is, the present invention can be also carried out by forming the shape of the electron beam apertures into an approximately elongated slot shape which has a long axis in one direction (generally in the vertical deflection direction) or into a continuous slit shape (line shape) in one direction (generally in the vertical deflection direction).

By adopting the shadow mask of this embodiment which uses the composite gradient alloy plate as the shadow mask material and by assembling the color cathode ray tube using such a shadow mask, a large merit which cannot be obtained with conventional techniques can be obtained.

Since the composite gradient alloy plate does not contain an expensive metal element such as cobalt or since the material which does not contain nickel can be used in the second composition portion, the composite alloy plate can be produced at a low cost compared to the conventional Invar material in terms of a material cost.

Since the composite gradient alloy plate does not contain cobalt which exhibits the favorable erosion resistance, the etching speed at the time of forming the electron beam apertures can be enhanced so that the manufacturing cost of the shadow masks can be reduced.

Due to the presence of the concentration ratio of the alloy element in the composite gradient alloy plate between the first composition portion and the second composition portion, the electron beam apertures can be etched in the optimum shape so that the electron beam apertures having the uniform cross-sectional shape can be formed.

Since the distribution of the stress generated at the time of press forming the composite gradient alloy plate is gradually changed in the inside of the alloy plate, no sharp load is applied to the alloy plate. Accordingly, the strength of the composite gradient alloy plate material can be increased 5 to 10 times compared to the conventional Invar material.

Since the nickel content can be reduced as a whole, the magnetic permeability is increased and the coercive force is decreased whereby the magnetic characteristics can be enhanced and the shield effect of the earth magnetism is enhanced.

Since the shadow mask material which is formed into a thin plate can increase the strength thereof, the generation of a local or partial doming (thermal expansion of the curved surface of the mask) caused by the impingement of the electron beams to the apertured surface of the mask can be reduced.

Figure 3:
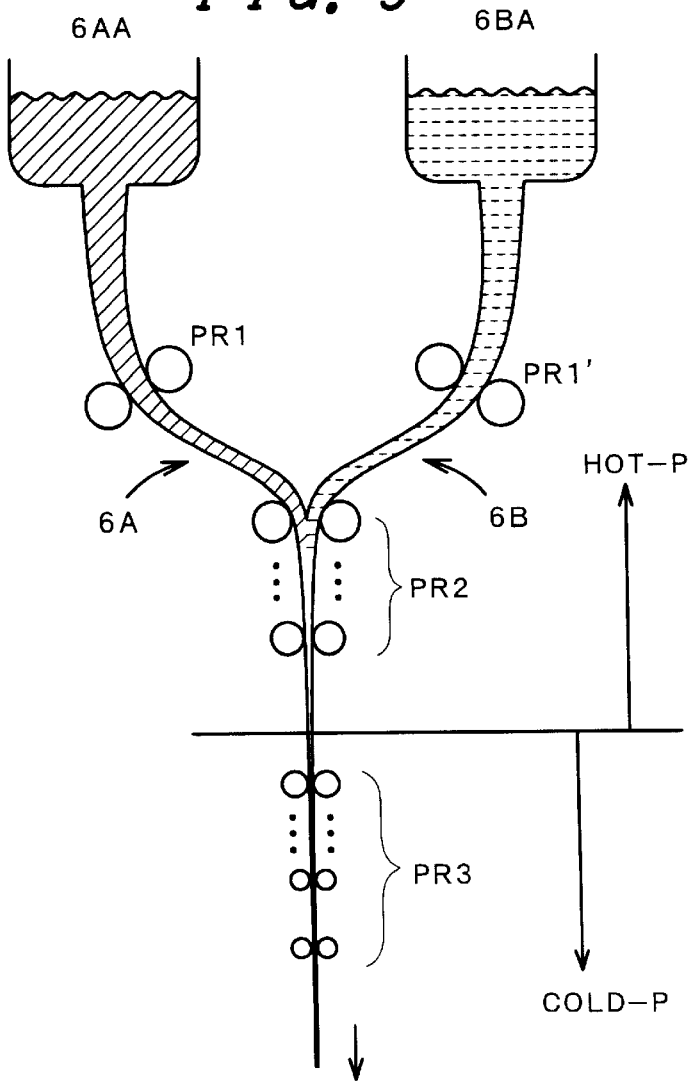
FIG. 3 is an explanatory view of an example of a method for manufacturing a composite gradient alloy plate which constitutes the material of a shadow mask used in a color cathode ray tube of the present invention.

FIG. 3 is an explanatory view of an example of a method for manufacturing the composite gradient alloy plate which constitutes the material of the shadow mask used in the color cathode ray tube of the present invention. Here, a case in which the first composition portion 6A is formed of Invar material (a nickel-iron alloy containing approximately 36 wt % of nickel) and the second composition portion 6B is formed of stainless steel containing approximately 16 wt % of nickel is explained.

In FIG. 3, numeral 6AA indicates fused material of Invar material and numeral 6BA indicates fused material of stainless steel containing approximately 16 wt % of nickel. These are drawn through rolling rollers PR1, PR1' as hot webs and are subjected to a hot rolling by using rolling rollers PR2 in several stages so as to merge them as a unitary body.

In such a hot rolling step, an alloy layer is formed between the Invar material 6A and the stainless steel material 6B containing 16 wt % of nickel whereby a composite gradient alloy plate having the concentration gradient in which the nickel content is gradually decreased from one surface of the single plate body to the other surface of the single plate body can be produced.

Thereafter, the composite gradient alloy plate is subjected to a cold rolling using rolling rollers PR3 in several stages so as to obtain a plate material having a desired thickness as a shadow mask material.

Figure 4:
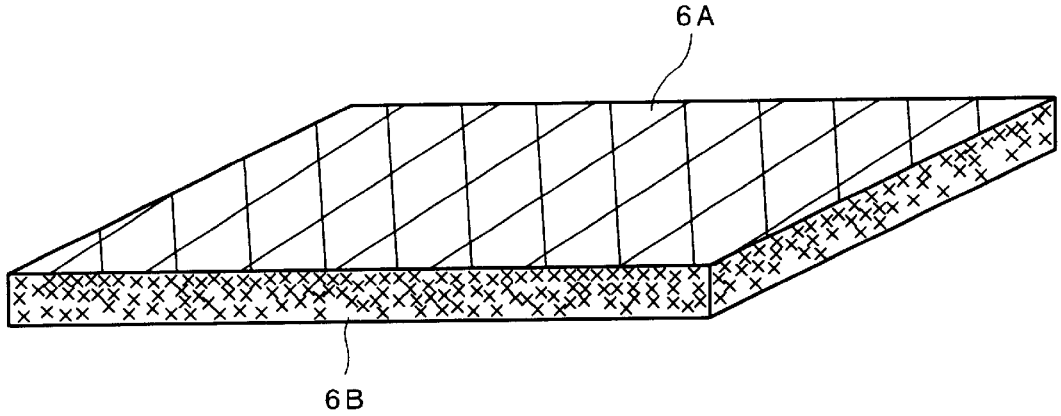
FIG. 4 is a perspective view for explaining the structure of the composite gradient alloy plate obtained in the manufacturing process shown in FIG. 3.

FIG. 4 is a perspective view for explaining the structure of the composite gradient alloy plate obtained by the manufacturing step shown in FIG. 3. The drawing shows a state in which the nickel content is gradiently changed between one surface side and the other surface side in a cross section similar to that of FIG. 1. Here, the concentration of the nickel element is indicated as the density of "x" in the same manner as the state shown in FIG. 1.

Figure 5A:
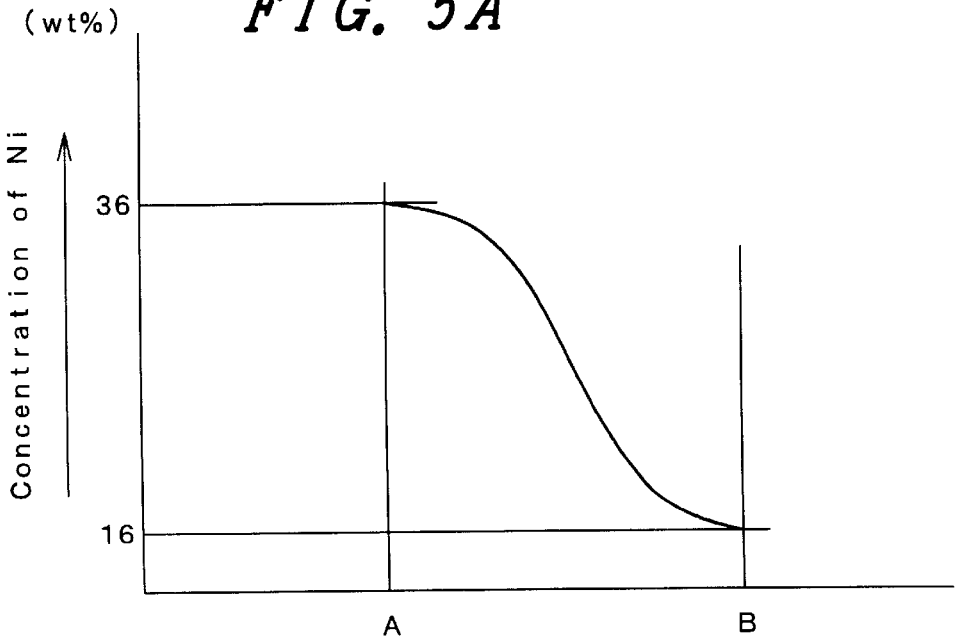
FIG. 5A and FIG. 5B are views showing the concentration distribution of nickel in the composite gradient alloy plate shown in FIG. 4.
Figure 5B:
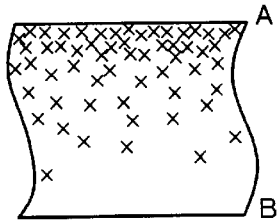

FIG. 5A and FIG. 5B show the concentration distribution of nickel in the composite gradient alloy plate shown in FIG. 4, wherein FIG. 5A shows the distribution curve of the nickel concentration and FIG. 5B is a schematic cross sectional view of the composite gradient alloy plate for explaining FIG. 5A. As shown in FIG. 5A, the content of nickel at one surface A side of the composite gradient alloy plate is 36 wt % which is exactly the nickel content of Invar material and the nickel content of the other surface B side of the composite gradient alloy plate is 16 wt % which is exactly the nickel content of the stainless steel containing approximately 16 wt % of nickel. Between the surface A side and the surface B side, the nickel content is gradually decreased from 36 wt % to 16 wt %. The shape of the distribution curve of the nickel concentration shown in FIG. 5A is changed depending on the thickness, temperature and rolling speed of the processing material and other conditions at the time of hot rolling and cold rolling.

Figure 6:
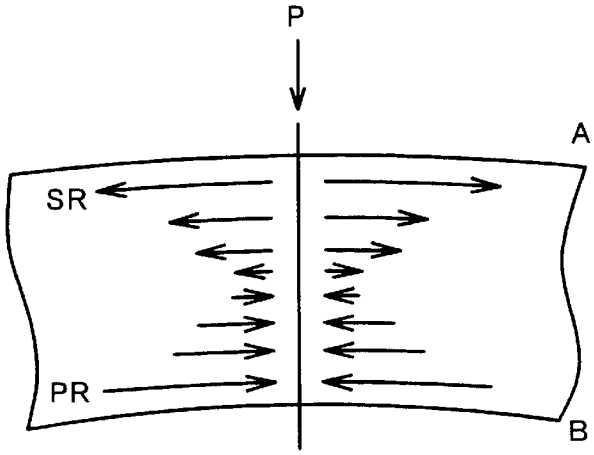
FIG. 6 is a cross-sectional schematic view for explaining the internal stress distribution of the composite gradient alloy plate which constitutes the material of the shadow mask used in the color cathode ray tube of the embodiment of the present invention.

FIG. 6 is a schematic cross-sectional view for explaining the distribution of an internal stress of the composite gradient alloy plate of this embodiment. When a pressure indicated by an arrow P shown in FIG. 6 is applied to the composite gradient alloy plate manufactured in the above-mentioned manner, for example, a tensile stress indicated by an arrow SR is generated outwardly from a pressure applying point at the surface A side and a compression stress indicated by an arrow PR is generated in the direction to compress inwardly at the surface B side. These tensile stress SR and compression stress PR are continuously decreased corresponding to the distribution of the nickel element shown in FIG. 5A in a region between the surface A and the surface B and become 0 at an approximately intermediate position.

In this manner, with respect to the cross section of the plate, the stress is gradually changed from the tensile stress SR to the compression stress PR and the distributions of respective stresses SR and PR are approximately symmetrical. Accordingly, the composite gradient alloy plate has a function of absorbing an external impact or shock.

Accordingly, when this composite gradient alloy plate is used as the shadow mask material, in a press forming which is carried out after forming the electron beam apertures, the relative position between the surface A and the surface B hardly offsets so that the shape of the electron beam apertures is hardly deformed.

When this composite gradient alloy plate is used as the shadow mask material, it becomes easy to form a curved surface of the mask with a little curvature so that it becomes possible to form the shadow mask with a little curvature which corresponds to an inner surface of the face panel which is made to approximate the flat surface.

With respect to the region which has the concentration gradient from one surface to the other surface in the single plate body made of the above-mentioned alloy element, it is preferable to form such a region over the whole shadow mask. However, the region may be partially formed corresponding to the usage of the color cathode ray tube.

For example, corresponding to the mechanical characteristics of the shadow mask against the external impact or the like and the thermal characteristics of the shadow mask against the impingement of electron beams or the like, the concentration gradient region of the alloy element may be formed at a region selected from a group consisting of the apertured region AR, a peripheral portion 61 (a skirt portion) and an outer peripheral portion surrounding the apertured region AR (non-apertured region) of the shadow mask 6 shown in FIG. 2.

Figure 7A:
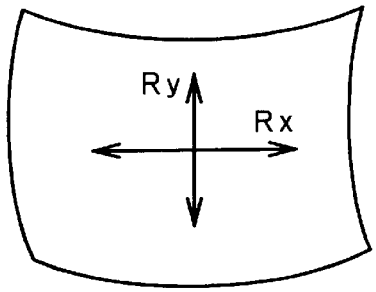
FIG. 7A, FIG. 7B and FIG. 7C are schematic explanatory views of images which are actually observed on a flat face panel having an inner surface of a large curvature when a shadow mask molded using Invar material as a comparison example of the present invention is assembled into such a face panel.
Figure 7B:
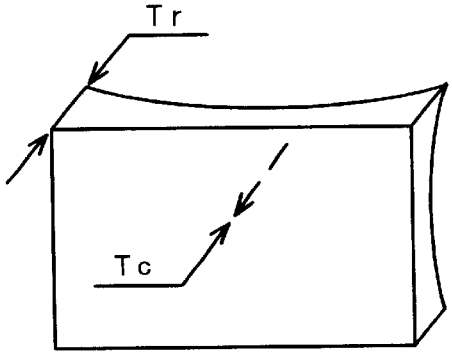
Figure 7C:
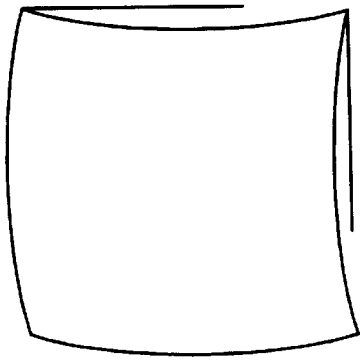

FIG. 7A is a schematic explanatory view of a shadow mask formed of Invar material as an comparison example of the present invention, FIG. 7B is a schematic explanatory view of a flat face panel having an inner surface with a large curvature and FIG. 7C is a schematic explanatory view of an image of the shadow mask which is actually observed on the face panel when the shadow mask is assembled to the face panel.

FIG. 7A shows an apertured region of the shadow mask which is formed by a press into a shape having an average radius of curvature Rx in the horizontal (along a long axis) direction of 1600 mm and an average radius of curvature Ry in the vertical (along a short axis) direction of 1300 mm. FIG. 7B shows an effective screen region of the face panel having an approximately flat outer surface and an inner surface of the large curvature. With respect to this effective screen region, a thickness Tr of a corner portion in the tube axis direction is set considerably larger than a thickness Tc of a center portion in the tube axis direction (Tr>>Tc). In this case, assume a wall thickness difference (Tr−Tc) between at the corner (an end in the diagonal direction) and at the center of the panel effective screen as a diagonal wedge amount Wr, the ratio Wr/Tc between the wedge amount Wr and the wall thickness Tc at the center of the face panel is set to not less than 1.2.

With respect to the shadow mask formed by a press, the shadow mask appears such that the screen is recessed more as a position on the shadow mask is shifted from the center of the panel to the periphery of the panel as shown in FIG. 7C. Then, with respect to the viewing direction, the center of the screen is bulged so that an image with a little flat feeling is observed.

Figure 8A:
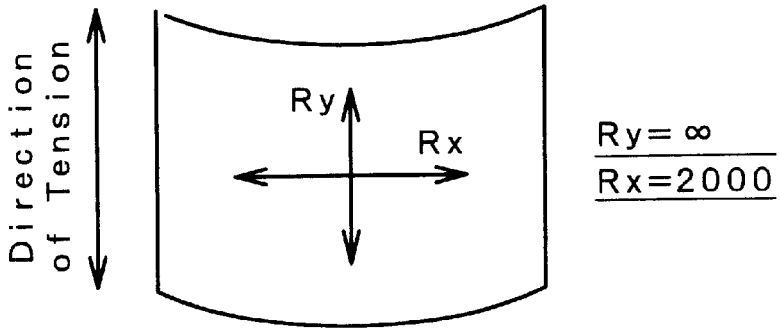
FIG. 8A, FIG. 8B and FIG. 8C are schematic explanatory views of images which are actually observed on a flat face panel having a curvature only in the horizontal direction when a shadow mask molded in a cylindrical surface shape is assembled into such a face panel.
Figure 8B:
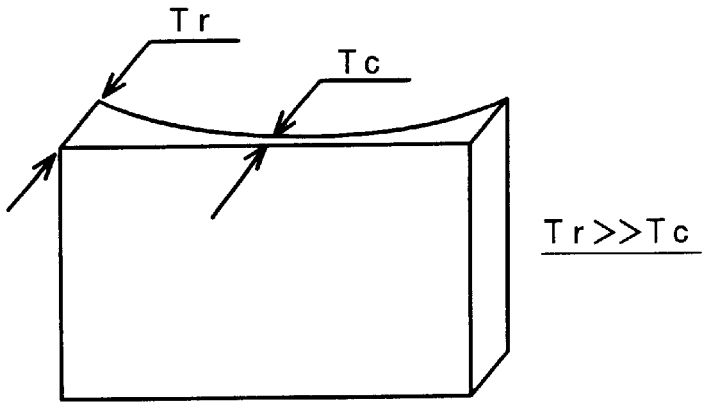
Figure 8C:
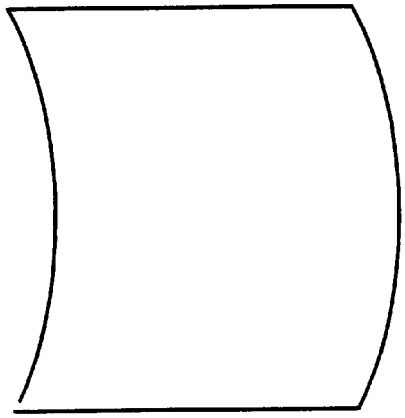

FIG. 8A is a schematic explanatory view of a shadow mask formed in a cylindrical surface shape, FIG. 8B is a schematic explanatory view of a flat face panel having a curvature only in the horizontal direction on an inner surface thereof, and FIG. 8C is a schematic explanatory view of an image of the shadow mask which is actually observed on the face panel when the shadow mask is assembled to the face panel.

FIG. 8A shows an apertured region of the shadow mask (a so-called line-like color selection electrode) which is formed into a shape having an average radius of curvature Rx in the horizontal (along a long axis) direction of 2000 mm and a radius of curvature Ry in the vertical (along a short axis) direction of an infinite value (∞). FIG. 8B shows an effective screen region of the face panel having an approximately flat outer surface and an inner surface which has a curvature only in the horizontal direction. With respect to this effective screen region, a thickness Tr of a corner portion in the tube axis direction is set considerably larger than a thickness Tc of a center portion in the tube axis direction (Tr>>Tc). In this case, the ratio Wr/Tc between the wedge amount Wr in the diagonal direction and the wall thickness Tc at the center of the face panel is set to not less than 1.0.

The shadow mask formed in the cylindrical surface shape constitutes a so-called tension mask to which tension is applied in the vertical direction as shown in FIG. 8A. It is difficult to make the shadow mask have a curvature in the tension applying direction. Accordingly, the inner surface of the face panel also has an approximately infinite radius of curvature with respect to the tension applying direction of the shadow mask. That is, the inner surface of the face panel is substantially linear in the vertical direction.

Accordingly, due to the refraction of the glass material which constitutes the face panel, the center portion of the face panel is observed such that it is curved in a concave shape in the vertical direction as shown in FIG. 8C.

Figure 9A:
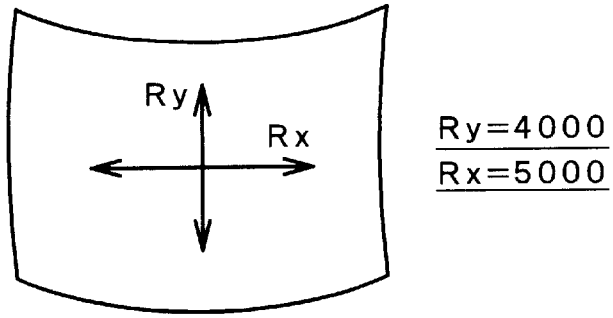
FIG. 9A, FIG. 9B and FIG. 9C are schematic explanatory views of images which are actually observed on a flat face panel having an inner surface of an extremely small curvature when a shadow mask molded using shadow mask material of the embodiment of the present invention is assembled into such a face panel.
Figure 9B:
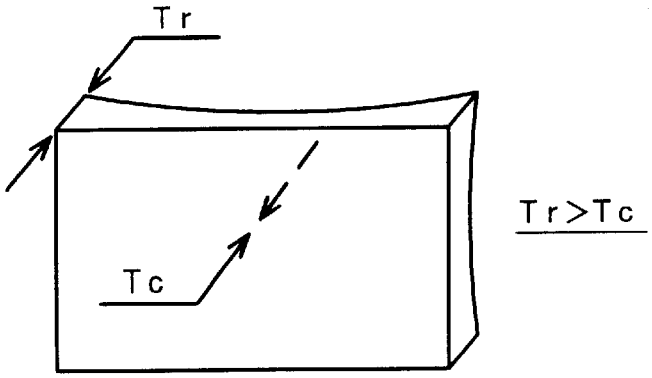
Figure 9C:
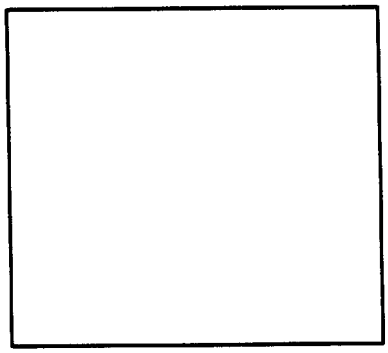

FIG. 9A is a schematic explanatory view of a shadow mask which is formed of the shadow mask material of this embodiment, FIG. 9B is a schematic explanatory view of a flat face panel having an inner surface with a small curvature and FIG. 9C is a schematic explanatory view of an image of the shadow mask which is actually observed on the face panel when the shadow mask is assembled to the face panel.

FIG. 9A shows an apertured region of the shadow mask which is formed by a press into a shape having an average radius of curvature Rx in the horizontal direction (along a long axis) of 5000 mm and an average radius of curvature Ry in the vertical direction (along a short axis) of 4000 mm. FIG. 9B shows an effective screen area of the face panel having an approximately flat outer surface and an inner surface with a curvature which is smaller than the curvature shown in FIG. 7B. With respect to this effective screen region, a thickness Tr of a corner portion in the tube axis direction is set slightly larger than a thickness Tc of a center portion in the tube axis direction (Tr>Tc).

With the provision of the constitution of this embodiment, the design of a cathode ray tube which satisfies conditions which make the shadow mask optically flat can be realized for the first time. That is, the shadow mask of this embodiment exhibits the large physical strength and the material for the shadow mask has a bimetal action and hence, the shadow mask per se has a doming correction function. Accordingly, with the use of a press, it becomes possible to form the shadow mask into a shape which is substantially flat, wherein an average radius of curvature Rx in the horizontal direction (along the long axis) and an average radius of curvature Ry in the vertical direction (along a short axis) are respectively set to not less than 3000 mm.

Accordingly, the difference (a corner wedge amount Wr) between a thickness Tr of a corner portion and a thickness Tc of a center portion of the face panel shown in FIG. 9B can be decreased so that an optical distance LrTr of the thickness Tr of the corner portion and an optical distance LcTc of the thickness Tc of the center portion become substantially equal. Accordingly, an image to be observed also becomes substantially flat as shown in FIG. 9C. In this case, the ratio Wr/Tc between the corner wedge amount Wr and the wall thickness Tc of the center portion of the panel is set to not more than 0.8.

Further, since the thickness of the peripheral portion of the face panel can be decreased, the image can easily obtain the high brightness so that the uniformity of the brightness over the whole screen can be enhanced.

Further, when the shadow mask material of this embodiment is applied to the tension mask shown in FIG. 8A, the curved surface can be formed such that the radius of curvature in the horizontal direction is increased and hence, the radius of curvature of the inner surface of the face panel in the horizontal direction can be also increased. Accordingly, in the same manner as the constitution shown in FIG. 9B, the thickness of the peripheral portion of the face panel can be decreased so that the brightness characteristics of the display screen can be enhanced.

Further, with respect to the tension mask shown in FIG. 8A, since the color selection apertures are formed like lines continuously extending in one direction, there may be a case that line-like grids which connect line-like color selection apertures vibrate due to an impact or the like. Accordingly, to prevent this vibration, a thin wire is mounted on the outside of the curved surface of the tension mask along the long axis (X axis). However, by applying the composite gradient alloy material according to the present invention to the tension mask, since the material strength of the composite gradient alloy material is considerably strong compared to the conventional Invar material, it is unnecessary to particularly mount the wire for preventing the vibration.

As has been described above, it becomes possible to make the press mask become substantially flat so that a suitable design can be carried out by making the inner surface of the face panel also substantially flat. Accordingly, it becomes possible to reduce the reflection light from the inner surface of the panel caused by the difference of wall thickness between the center portion and the peripheral portion of the panel shown in FIG. 7B without requiring reflection prevention means such as an inner surface filter film or the like. Further, since the peripheral portion of the face panel can be made thin by making the inner surface of the panel become substantially flat, the panel can be made light-weighted and the manufacturing cost of the color cathode ray tube can be reduced.

Further, also with respect to the color cathode ray tube using the so-called tension mask to which the tension is applied in one direction (generally in the vertical direction), the radius of curvature of the inner surface in the direction (generally in the horizontal direction) perpendicular to one direction of the face panel to which the present invention is applied can be increased and hence, the wall thickness of the peripheral portion of the panel can be made thin whereby the reflection light from the inner surface of the panel can be suppressed, the panel can be made light-weighted, and the manufacturing cost of the color cathode tube ray can be reduced.

Further, by setting the average radius of curvature Ry of the premask of this embodiment shown in FIG. 9A along the short axis (Y axis) to not less than 10000 mm, in place of the tension mask, the premask of this embodiment can be applied to the face panel which has the inner surface thereof shown in FIG. 8B formed in a cylindrical surface shape and increases the radius of curvature of the inner surface thereof in the long axis (X axis) direction.

Further, the shadow mask material of this embodiment is formed of the composite gradient alloy plate and the composite gradient alloy plate per se has the bimetal action function. This enables the design which can correct the partial doming of the curved surface of the mask, for example, the local doming due to the window pattern display.

The conventional shadow mask structural body has performed the correction of the doming of a curved surface of a mask caused by the impingement of electron beams and the thermal expansion of a mask frame caused by the elevation of the ambient temperature by using suspension springs mounted on the mask frame. In this embodiment, due to the bimetal action function of the shadow mask per se, the correction of the doming can be performed by the shadow mask per se. Accordingly, it is sufficient to specify the design of the suspension springs only with respect to the correction of the thermal expansion of the mask frame so that the tolerance of design of the whole shadow mask structural body can be enhanced. As a result, it becomes possible to provide a color cathode ray tube having high brightness and high definition which is operable also in the high current region in which the doming correction has been impossible conventionally.

Although this embodiment has been explained with respect to the case in which the nickel-iron alloy material which uses iron as the base material and contains nickel as the alloy element is used as the composite gradient alloy plate has been explained, the composite gradient alloy plate is not limited to such an alloy material. That is, this embodiment can be performed in the same manner by using an iron alloy material which contains chromium or nickel and chromium, various kinds of stainless steel, an iron alloy which contains other alloy element.

In the above-mentioned embodiment, the content of the same alloy element (for example, nickel) is changed with respect to the first composition portion and the second composition portion. However, the present invention is not limited to such a constitution. That is, the composite gradient alloy plate may be constituted such that different alloy elements are used in the first composition portion and the second composition portion respectively, wherein the content of the alloy element in the first composition portion is gradually decreased from one surface of a plate body to the other surface of the plate body, and the content of the alloy element in the second composition portion is gradually decreased from the other surface of the plate body to one surface of the plate body. For example, even when nickel is used as the alloy element of the first composition portion and silicon is used as the alloy element of the second composition portion, an advantageous effect similar to that of the above-mentioned embodiment can be obtained.

Figure 10:
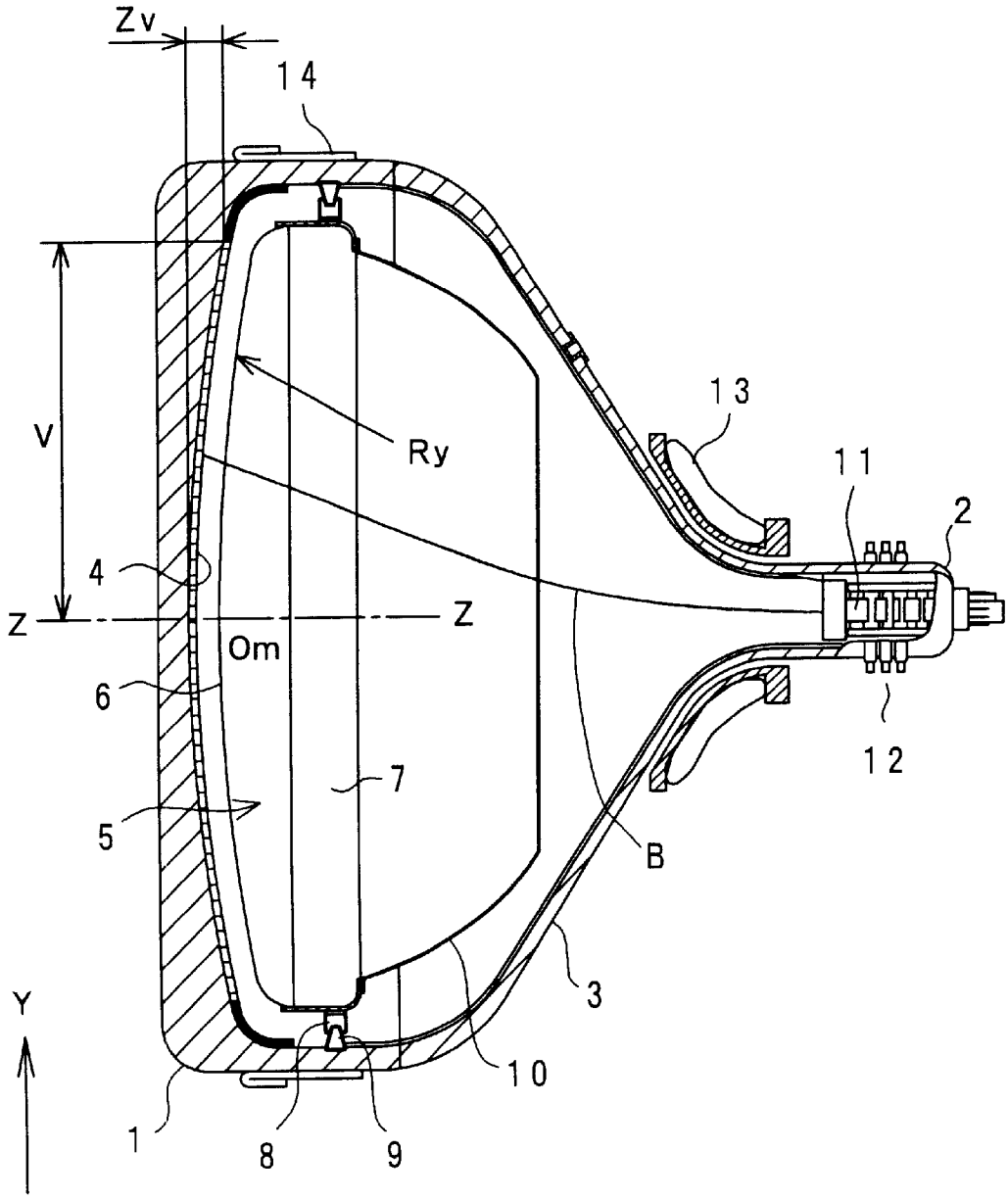
FIG. 10 is a schematic cross-sectional view for explaining one example of the whole constitution of a color cathode ray tube of the present invention.

FIG. 10 is a schematic cross-sectional view for explaining one example of the whole constitution of the color cathode ray tube of the present invention. This color cathode ray tube includes an evacuated envelope which is comprised of a panel (face panel) 1 which coats phosphor of a plural colors on an inner surface thereof, a neck 2 which houses an electron gun 11 and a funnel 3 having an approximately funnel shape which connects the panel 1 and the neck 2.

The phosphor 4 of three colors is coated on the inner surface of the panel 1 and the shadow mask 6 which has a large number of color selection apertures is installed close to the phosphor 4. Numeral 5 indicates a shadow mask structural body. The shadow mask 6 which constitutes the shadow mask structural body 5 is formed of the composite gradient alloy plate in which a large number of electron beam apertures formed by etching the composite gradient alloy plate is formed and is fixedly secured to a mask frame 7 by welding.

The shadow mask 6 is curved with large radii of curvature in the horizontal direction as well as in the vertical direction. Assume an axis which is perpendicular to a short axis (Y axis: an arrow Y direction in the drawing) of an approximately rectangular apertured region of the shadow mask 6 and passes the center Om of the apertured region as the Z axis (the tube axis) and a falling amount in the Z axis direction from the center Om of the apertured region at an arbitrary point (x, y) in the apertured region of the shadow mask 6 as Zm, a curved shape of the shadow mask 6 can be generally defined by a following equation.

$$Zm=A1x^2+A2x^4+A3y^2+A4y^4+A5x^2y^2+A6x^2y^4+A7x^4y^2+A8x^4y^4 \text{ (A1 to A8: coefficient)}$$

Then, a desired curved shape can be obtained by determining the coefficients A1 to A8 in the equation.

Although the above-mentioned curved shape is defined by taking the shadow mask 6 as an example, the curved shape of the effective screen region may be defined in the same manner.

The curved surface expressed by the above-mentioned definition equation is an aspherical shape in many cases and hence, the radii of curvature thereof are different depending on arbitrary positions of the curved surface. Accordingly, the curvature (radius of curvature) of the shadow mask can be defined by a following equation by assuming such a curvature as an average radius of curvature described in FIG. 9A.

$$Ry=(Zv^2+V^2)/2Zv$$

wherein Ry indicates an average radius of curvature (mm) along the short axis (Y axis) of the apertured region, V indicates a distance (mm) in the direction perpendicular to the Z axis from the center Om of the apertured region to the end portion along the Y-axis, and Zv indicates a fall amount (mm) in the Z axis direction between the center Om of the apertured region and the end portion along the Y axis.

Although the above-mentioned average radius of curvature is defined along the short axis (Y axis) of the apertured region of the shadow mask, the average radius of curvature can be defined along the long axis (X axis) or along the diagonal line in the same manner. Further, the average radius of curvature can be defined in the same manner with respect to the effective screen region of the panel 1.

A magnetic shield 10 is fixedly secured to an electron-gun-side of the mask frame 7, while the mask frame 7 is suspended and held by stud pins 9 which are mounted in a protruding manner on an inner wall of a skirt portion of the panel 1 by way of the suspension springs 8.

A deflection yoke 13 is exteriorly mounted on a neck side of the funnel 3 and deflects three electron beams B irradiated from the electron gun 11 in the horizontal direction as well as in the vertical direction (an arrow Y direction in the drawing) so as to form an image on the phosphor screen 4. In the drawing, numeral 12 indicates a magnetic correction device for the purity correction, the convergence correction or the like, and numeral 14 indicates an implosion band.

With the provision of the color cathode ray tube having such a constitution, the color image display of high brightness and high definition which can suppress the color slurring caused by doming of the curved surface of the shadow mask can be obtained.

Figure 11:
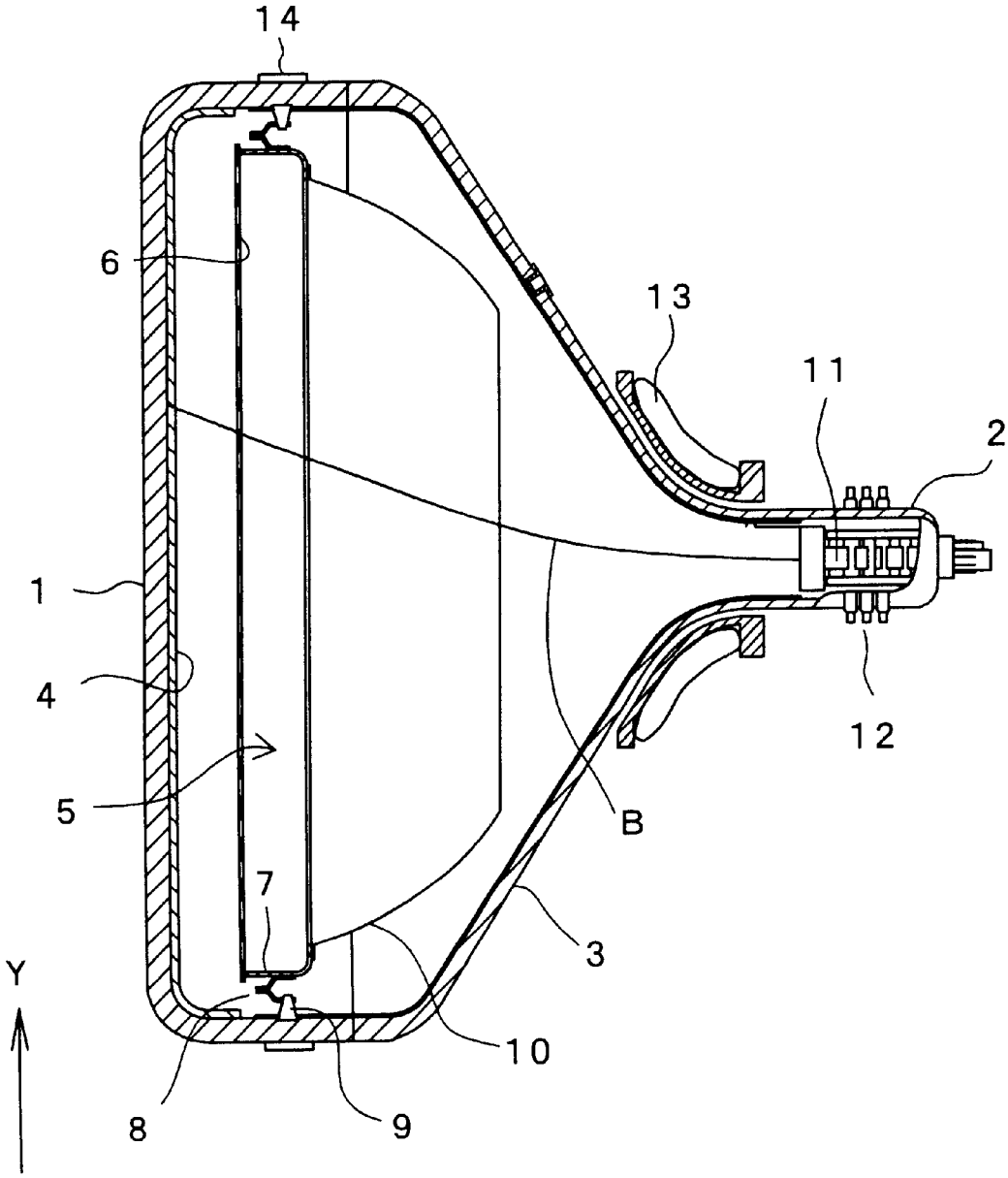
FIG. 11 is a schematic cross-sectional view for explaining another example of the whole constitution of a color cathode ray tube of the present invention.

FIG. 11 is a schematic cross-sectional view for explaining other embodiment of the whole constitution of a color cathode ray tube of the present invention. In the drawing, numerals which are equal to the numerals used in FIG. 10 correspond to identical functional parts. This color cathode ray tube includes an evacuated envelope which is comprised of a panel 1 having an inner surface on which phosphor of a plurality of colors is coated, a neck 2 housing an electron gun 11 and an approximately funnel-shaped funnel 3 which connects the panel 1 and the neck 2. However, in this embodiment, the inner surface of the panel 1 has a large radius of curvature in the horizontal direction and an infinite radius of curvature in the vertical direction (an arrow Y direction in the drawing).

A shadow mask 6 which constitutes a color selection electrode installed in the color cathode ray tube has a large radius of curvature in the horizontal direction and has a radius of curvature in the vertical direction which is considerably larger than the radius of curvature in the horizontal direction or is infinite.

The shadow mask 6 is fixedly secured to the mask frame 7 while being applied with tension. However, the shadow mask 6 may be fixedly secured to the mask frame 7 in the state that the shadow mask 6 holds a shape thereof by itself without being applied with tension. Even when the shadow mask is fixedly secured to the mask frame 7 in the state that the shadow mask 6 holds the shape thereof by itself without being applied with tension, the doming can be corrected by the bimetal function of the shadow mask and the color slurring or the like can be reduced.

With the provision of the color cathode ray tube having such a constitution, the color image display of high brightness and high definition which can suppress the color slurring caused by doming can be obtained.

As has been explained heretofore, according to the typical constitutions of the present invention, the material of the shadow mask which constitutes the color selection electrode does not contain the expensive metal element such as cobalt or the like or it is possible to adopt the material which does not contain nickel or the like at one surface side. Accordingly, the material cost can be reduced compared with the conventional Invar material, the etching property in forming the electron beam apertures can be enhanced, and the electron beam apertures can be etched in a proper shape due to the ratio of the alloy region in the composite gradient alloy plate so that the electron beam apertures having the uniform cross-sectional shape can be formed.

Further, since the nickel content can be reduced as a whole, the magnetic characteristics are enhanced, the shield effect of the earth magnetism is enhanced, the strength of the shadow mask material made of the thin plate is largely increased so that the occurrence of the local doming can be reduced whereby it becomes possible to provide the color cathode ray tube of high brightness and high definition while having the thin face panel.

What I claim is:

1. A color cathode ray tube having an evacuated envelope which includes a panel which coats phosphor of a plurality of colors on an inner surface thereof, a neck which houses an electron gun and a funnel which connects the panel and the neck and a shadow mask which is installed between the electron gun and the phosphor and has an apertured region formed of plural color selection apertures, wherein material which constitutes the shadow mask is formed of a plate body made of an iron material containing an alloy element and the plate body is a composite gradient alloy plate having a concentration gradient of the alloy element which is continuously decreased from a phosphor-side surface to an electron-gun-side surface of the plate body.

2. A color cathode ray tube according to claim 1, wherein the apertured region of the shadow mask is curved along a long axis thereof and an average radius of curvature is set to not less than 3000 mm.

3. A color cathode ray tube according to claim 1, wherein the alloy element is nickel.

4. A color cathode ray tube according to claim 3, wherein the content of nickel in the vicinity of the phosphor-side surface of the plate body is set to not more than 45 wt % and the content of nickel in the vicinity of the electron-gun-side surface of the plate body is set to not less than 0 wt %.

5. A color cathode ray tube according to claim 4, wherein the content of nickel in the vicinity of the side—side surface of the plate body is set to not more than 36 wt % and the content of nickel in the vicinity of the electron-gun-side surface of the plate body is set to not less than 16 wt %.

6. A color cathode ray tube according to claim 1, wherein the alloy element is chromium.

7. A color cathode ray tube according to claim 1, wherein the color selection apertures formed in the shadow mask are formed in a dot array.

8. A color cathode ray tube according to claim 1, wherein the color selection apertures which are formed in the shadow mask are formed like a plurality of continuous dotted lines extending in one direction.

9. A color cathode ray tube according to claim 1, wherein the color selection apertures which are formed in the shadow mask are formed of a plurality of slots having long axes thereof extended in one direction.

10. A color cathode ray tube having an evacuated envelope which includes a panel which coats phosphor of a plurality of colors on an inner surface thereof, a neck which houses an electron gun and a funnel which connects the panel and the neck and a shadow mask which is installed between the electron gun and the phosphor and has an apertured region formed of plural color selection apertures, wherein material which constitutes the shadow mask is formed of a single plate body made of an iron material containing an alloy element and a content of the alloy element at an electron-gun-side surface of the single plate body is set smaller than a content of the alloy element at a phosphor-side surface of the single plate body.

11. A color cathode ray tube according to claim 10, wherein the apertured region of the shadow mask is curved along a long axis thereof and an average radius of curvature is set to not less than 3000 mm.

12. A color cathode ray tube according to claim 10, wherein the alloy element is nickel.

13. A color cathode ray tube according to claim 12, wherein the content of nickel in the vicinity of the phosphor-side surface of the single plate body is set to not more than 45 wt % and the content of nickel in the vicinity of the electron-gun-side surface of the single plate body is set to not less than 0 wt %.

14. A color cathode ray tube according to claim 13, wherein the content of nickel in the vicinity of the phosphor-side surface of the single plate body is set to not more than 36 wt % and the content of nickel in the vicinity of the electron-gun-side surface of the single plate body is set to not less than 16 wt %.

15. A color cathode ray tube according to claim 10, wherein the alloy element is chromium.

16. A color cathode ray having an evacuated envelope which includes a panel which coats phosphor of a plurality of colors on an inner surface thereof, a neck which houses an electron gun and a funnel which connects the panel and the neck and a shadow mask which is installed between the electron gun and the phosphor and has plural color selection apertures, wherein material which constitutes the shadow mask is formed of a single plate body made of an iron material containing an alloy element and the alloy element contained in the single plate body is different between one surface and the other surface of the single plate body.

17. A color cathode ray tube according to claim 16, wherein one surface of the single plate body constitutes a phosphor side and the other surface of the single plate body constitutes an electron-gun-side.

18. A color cathode ray tube according to claim 16, wherein the alloy element contained in one surface of the single plate body is nickel and the alloy element contained in the other surface of the single plate body is silicon.

* * * * *